United States Patent [19]

Payne et al.

[11] Patent Number: 4,853,140

[45] Date of Patent: Aug. 1, 1989

[54] LUBRICATING FLUIDS FOR SLICING SILICON INGOTS

[75] Inventors: Charles C. Payne, Aurora; Earnest M. Kerr, Naperville, both of Ill.

[73] Assignee: Nalco Chemical Company, Naperville, Ill.

[21] Appl. No.: 312,012

[22] Filed: Feb. 16, 1989

Related U.S. Application Data

[63] Continuation of Ser. No. 87,844, Aug. 21, 1987, abandoned.

[51] Int. Cl.[4] ..... C10M 173/00

[52] U.S. Cl. ..... 252/34; 252/49.3

[58] Field of Search ..... 252/34, 49.3

[56] References Cited

U.S. PATENT DOCUMENTS 2,425,845 8/1947 Toussaint et al. .
2,825,693 2/1958 Beaufein et al. .
2,958,661 11/1960 Reamer et al. .
3,006,849 10/1961 Plemich .
3,629,112 12/1971 Gower et al. .
3,980,571 9/1976 Marx .
4,169,337 10/1979 Payne .
4,356,107 10/1982 Payne .
4,631,139 12/1986 Burton/Kushner .

FOREIGN PATENT DOCUMENTS 1055757 5/1982 Czechoslovakia .

*Primary Examiner*—Dixon Jr., William R.
*Assistant Examiner*—Jerry D. Johnson
*Attorney, Agent, or Firm*—John G. Premo; Anthony L. Cupoli; Donald G. Epple

[57] ABSTRACT

A lubricating composition for use in slicing or cutting silicon wafers. The composition includes a soap, a phosphorous containing compound, and an ethylene oxide-propylene oxide polymer. The phosphorous compound is a low temperature, extreme pressure lubricant. The ethylene oxide propylene oxide polymer is a high temperature, extreme pressure lubricant. Suitable soaps include C6–C18 fatty acids reacted with triethanolamine or aminoethanolamine. Additionally, biocides or fungicides may be added. Also an antifoam and a complexing aid such as EDTA may be used.

11 Claims, No Drawings

LUBRICATING FLUIDS FOR SLICING SILICON INGOTS

This is a continuing application of Ser. No. 087,844, filed Aug. 21, 1987 now abandoned.

FIELD OF THE INVENTION

The invention relates to the field of lubricants for cutting or slicing silicon wafers which are to be used in the electronics industry.

BACKGROUND OF THE INVENTION

Many of the lubricating fluids which exist today for use in facilitating the cutting or slicing of silicon wafers have been designed primarily with the intention of prolonging the life of the blade used in the slicing or cutting operation.

This interest in reducing the cost of blade replacement can result in the use of lubricants which do not produce high quality wafers. These lubricants will frequently provide wafers which exhibit a high level of imperfections. These imperfections can be demonstrated in terms of "thickness", "bow" and "taper". Some variance in thickness, bow and taper is tolerated. The elimination of these problems is left to subsequent lapping and polishing steps.

These problems exist for simple mechanical reasons. An ultra thin wafer is being sliced from a large block of silicon. If lubricatation isn't sufficient, the thin wafer will vibrate as it is being sliced. This vibration can result in a certain unevenness in the cut. Additionally, as that thin wafer is being sliced it could tend to bow out slightly from the main block of silicon. The lubricant is designed to reduce the friction of the blade cutting through the silicon block.

It would be advantageous to find a lubricant which would sufficiently reduce the friction found in this cutting process to minimize the problems of thickness variation, bowing, and undue taper.

SUMMARY OF THE INVENTION

A lubricant for use in cutting silicon wafers comprising a soap prepared from a C6–C18 fatty acid and an amine selected from the group consisting of monoethanolamine, diethanolamine, triethanolamine and aminoethylethanolamine and any mixture thereof;

and phosphorus-containing compound; and an ethylene oxide-propylene oxide polymer.

In addition to the above components, biocides antifoams, and complexing agents for hardness may be utilized.

This lubricant composition is used in the process of lubricating the blade as silicon wafers are sliced.

In addition to permitting a smoother more uniform silicon wafer to be produced, the above a lubricant has the advantage of being a liquid which does not form deposits on the cutting edges of the blade, the wafer or the equipment.

DESCRIPTION OF THE PREFERRED EMBODIMENT

In the production of silicon wafers, it is quite common to use a diamond blade to slice a thin wafer from an end of a silicon block. Unless the diamond blade is sufficiently lubricated, an uneven wafer will be formed. This is undesirable.

A soap can be used as a lubricant. The soap will provide hydrodynamic lubrication.. That is the soap will provide lubrication at low pressure and low temperature, and to facilitate kerf removal. As the blade begins cutting, the pressure will build up and with it the temperature. At these more extreme conditions, the soap no longer serves as an effective lubricant. However, a phosphorous containing compound will provide lubrication for the blade up to approximately 400° F. At approximately 400° F. the lubricating value of the phosphorous becomes significantly reduced. In order to provide proper lubrication for the blade, it is necessary to add an additional lubricant which is beneficial at the temperatures ranging from 400° to 1200° F. and which occurs as the cutting edge continues to slice through the silicon. Thus, the basic composition of this invention includes a soap for hydrodynamic lubrication, at least one phosphorous compound for low temperature (up to 400° F.), extreme pressure lubrication as an ethylene oxide, propylene oxide polymer for high temperature (greater than 400° F.), extreme pressure lubrication.

The soap is a carboxylic acid amine soap. The carboxylic acid preferably is a $C_6$–$C_{18}$ monocarboxylic acid. More preferably the soap is a $C_6$–$C_{14}$ monocarboxylic acid and most preferably the soap is caprylic acid.

The amine is most preferably either triethanolamine or aminoethylethanolamine.

The phosphorous compound is preferably an inorganic phosphate such as an orthophosphate, a metaphosphate, a pyrophosphate, or a mixture thereof. Preferably, the phosphate is produced in situ by the reaction of phosphoric acid and a caustic such as sodium hydroxide or potassium hydroxide. The phosphate provide both lubrication and detergency.

Organic phosphates known to have extreme pressure lubrication characteristics may also be utilized. Examples of these are butyl acid phosphate, amyl acid phosphate, etc.

The extreme pressure, high temperature lubricant is most preferably an ethylene oxide propylene oxide polymer. Most preferably, this extreme pressure high temperature lubricant is Ucon EPML-X, a trademark of Union Carbide for an ethylene oxide-propylene oxide polymer, having a viscosity of 9,000–12,000 SUS measured at 100° F. The viscosity for the ethylene oxide/-propylene oxide polymer used in the examples was tested and fell within this 9,000–12,000 SUS range. Preferably, the polymer should have a viscosity of at least 9000 Saybolt Universal Seconds (SUS). A viscosity in the range of 9,000–12,000 SUS, will provide good results.

The composition can be effectively used as a aqueous solution in which the weight ratio of water to composition is at least 100:1. More preferably, the weight ratio should be at least 200:1. And, most preferably, 400:1. Aqueous composition having weight ratio of 400:1 or greater will produce acceptable wafers.

The Biocides

In addition to the above lubricants, it is desirable that the composition include a biocide. Biocides commonly used in the field may be utilized these include but are not limited to GROTAN a trademark of Lehn & Fink for a biocide and Sodium Omadine a trademark of Olin Chemical Co. for a fungicide.

Complexing Agents

It is also desirable but not necessary to add complexing agents for hardness. The complexing agent should readily complex with calcium and magnesium under alkaline conditions in the presence of potassium and sodium. A desirable complexing agent is ethylenediaminetetracetic acid (i.e. EDTA) a most preferred form is the acid form of EDTA. Other complexing agents are also usable. Included amoung these are tartaric acid, nitrilotriacetic acid, citric acid and gluconic acid.

The Antifoamer

It is also desirable, but not necessary to add an antifoam agent. The antifoam should have dispersible properties in water and not leave a residue on the silicon wafer. Paste type defoamers, dispersion type defoamers, water based defoamers, etc. may be utilized as long as they have these characteristics. Specifically, ethylene bis-stearamide and an antifoam such as FoamBan, a trademark of Ultra Adhesive are acceptable. Other antifoams commonly known may also be used.

Table I below provides a compositions of lubricants for a Composition A and Composition B.

TABLE I

| Ingredient | Composition A (wt %) | Composition B (wt %) |
|---|---|---|
| Caprylic Acid (100% Active) | 10.0 | 8.0 |
| Amine (99% active) | 7.0 | 17.0 |
| Caustic (NaOH 50% active KOH 45% active) | 4.0 | 5.0 |
| Phosphoric Acid | 1.0 | 1.0 |
| Ucon EPML-X | 3.0 | 5.0 |
| GROTAN (100% active) | 3.0 | 0.2 |
| Sodium Omadine (40% active) | 0.2 | 0.0 |
| EDTA, Acid Form | 0.5 | 1.0 |
| Defoamer (30% actives) | 0.2 | 1.0 |
| Water | 71.1 | 61.8 |

Table II below provides the run parameters for the equipment to be used in slicing or cutting the silicon wafers.

TABLE II

| Run Parameters | |
|---|---|
| Slicing Machine | * STC |
| Slicing Speed | 1800 rpm |
| Ingot Feed Rate | 1.2 inches/minute |
| Flow Rate | 1-2 Gallons/minute |
| Blade Characteristics | |
| Type | ** Diamotec |
| Condition | New |

TABLE II-continued

| Run Parameters | |
|---|---|
| Thickness | 11 mil diamond<br>5 mil SS core<br>8" ID<br>11" OD |
| Tension | 45 mm |
| Ingot Characteristics | |
| Type | 111 (boron doped) |
| Cut | 3° off orientation |
| Thickness (index | 17 mil/slice |
| Diameter | 3 inches |
| Customer Wafer Specifications | |
| Thickness | 17 0.5 mils |
| Bow | 1.0 mil maximum |
| Taper | 0.5 mil maximum |
| Blade Dressing | |
| Type | A320 grit alumina, 1" square |
| Number of Times | 10 (initially); then as needed |

*STC is a trademark of Silicon Technology Corporation
**Diamotec is a trademark of Diamotec Corporation for silicon cutting blades Table III provides the actual cutting or slicing results for composition A and B using the parameters of Table II.

In practice, a lubricant was continually added to the silicon surface being cut.

TABLE III

| | | | Slicing Results | | | | |
|---|---|---|---|---|---|---|---|
| | | | | | 1000 u/Mil | | |
| Product | Dilution Water/Product | Thickness (mils) | Taper (mils) | Bow (mils) | Front Side of Wafer Ave Depth | Back Side of Wafter Ave Depth | Comments |
| A | 100:1 (first run) | 17.0 | 0.2 | 1.1 | 16.3 | 32.3 | No cooling |
| A | 100:1 (second run) | 17.2 | 0.1 | 0.5 | 17.3 | 20.8 | No cooling |
| A | 200:1 | 17.1 | 0.1 | 0.9 | 14.1 | 15.8 | No cooling |
| A | 400:1 | 17.1 | 0.2 | 0.2 | 11.7 | 14.4 | No cooling |
| B | 200:1 | 17.0 | 0.1 | 0.5 | 13.7 | 16.1 | No cooling |
| B | 400:1 | 17.1 | 0.2 | 0.5 | 13.8 | 15.6 | No cooling |
| *C | 400:1 | 17.1 | 0.2 | 0.5 | 15.0 | 16.5 | With cooling |

*C - A commercial silicon slicing lubricant.

As shown from Table III, lubricant A or B permits production of a sliced wafer at 100:1–600:1 and dilution with a thickness of 17.0+0.5 mils, 0.5 mils maximum taper, and 1.0 mil maximum bow.

These results are better than commercial product C. The results are based on using a diamond blade. Some variances may occur due to blade variances.

The front side of the wafer is the side of the wafer the blade is cutting. The back side of the wafer is the side previously cut.

Having described our invention we claim as follows:

1. An aqueous lubricant composition for use in cutting silicon wafers comprising water a complexing agent for complexing hardness, a biocide, and fungicides, a soap prepared from a C6–C18 fatty acid and an amine selected from the group consisting of monoethanolamine, diethanolamine, triethanolamine and aminoethylethanolamine;

and a phosphorous compound having extreme pressure lubricant properties and;

an ethylene oxide-propylene oxide polymer having a viscosity range at 9,000–12,000 SUS determined at 100° F.; said composition having a water to composition weight ratio of at least 100:1.

2. The lubricant of claim 1 wherein the complexing agent is the acid form of ethylenediaminetetracetic acid.

3. The lubricant of claim 2 further including an anti-foaming agent.

4. The lubricant of claim 1, wherein the amine is triethanolamine.

5. The lubricant of claim 1, wherein the amine is aminoethylethanolamine.

6. The method of silicing a silicon wafer comprising the steps of adding the lubricant composition of claim 1 to a silicon wafer, said composition having a water to composition weight ratio of at least 200:1 and slicing wafer.

7. A method of slicing a silicon wafer comprising the steps of adding a lubricant composition to a silicon wafer; said composition comprising a soap prepared from a $C_6$–$C_{18}$ fatty acid and an amine selected from the group consisting of monoethanolamine, diethanolamine, triethanolamine and aminoethylethanolamine;

a phosphorous compound having extreme pressure lubrication properties;

a complexing agent for complexing hardness; and an ethylene oxide propylene oxide polymer havin a viscosity range at 9000–12,000 SUS, where SUS is determined at 100° F., said composition having first been diluted with water to at least 100:1 water to composition weight ratio; and slicing said wafer.

8. The method of claim 7 wherein the dilution is at least 200:1.

9. The method of claim 7 wherein the dilution is at least 400:1.

10. The method of claim 7 wherein the phosphorous compound is an inorganic phosphate.

11. The method of claim 10 wherein the inorganic phosphate is selected from the group consisting of orthophosphate, metaphosphate, or pyrophosphate.

* * * * *

UNITED STATES PATENT AND TRADEMARK OFFICE

CERTIFICATE OF CORRECTION

PATENT NO. : 4,853,140

DATED : AUGUST 1, 1989

INVENTOR(S) : CHARLES C. PAYNE, et al

It is certified that error appears in the above-identified patent and that said Letters Patent is hereby corrected as shown below:

Column 6, Line 4, Claim 7 ethylene oxide propylene oxide polymer [havin] a

SHOULD READ AS:

ethylene oxide propylene oxide polymer <u>having</u> a

Signed and Sealed this

Twenty-sixth Day of June, 1990

*Attest:*

HARRY F. MANBECK, JR.

*Attesting Officer*

*Commissioner of Patents and Trademarks*